US012005298B2

(12) United States Patent
Hollern

(10) Patent No.: US 12,005,298 B2
(45) Date of Patent: Jun. 11, 2024

(54) WEIGHTED PAD FOR WEIGHTLIFTING

(71) Applicant: Megan Lynne Hollern, Worthington, OH (US)

(72) Inventor: Megan Lynne Hollern, Worthington, OH (US)

( * ) Notice: Subject to any disclaimer, the term of this patent is extended or adjusted under 35 U.S.C. 154(b) by 3 days.

(21) Appl. No.: 17/651,927

(22) Filed: Feb. 22, 2022

(65) Prior Publication Data

US 2023/0264072 A1 Aug. 24, 2023

(51) Int. Cl.
*A63B 21/00* (2006.01)
*A63B 21/065* (2006.01)

(52) U.S. Cl.
CPC ..... *A63B 21/4037* (2015.10); *A63B 21/065* (2013.01); *A63B 21/4039* (2015.10); *A63B 21/4005* (2015.10); *A63B 2244/09* (2013.01)

(58) Field of Classification Search
CPC ..... A63B 21/065; A63B 21/4005; A63B 21/4037; A63B 21/4039; A63B 2244/09
See application file for complete search history.

(56) References Cited

U.S. PATENT DOCUMENTS 4,407,497 A * 10/1983 Gracie ..... A63B 21/065 2/912
4,602,387 A * 7/1986 Zakrzewski ..... A63B 21/065 2/2.5
D390,338 S * 2/1998 Plasco ..... D21/683
6,665,879 B2 * 12/2003 VandenBerg ..... A63B 21/065 2/102
6,669,608 B1 * 12/2003 Winston ..... A63B 21/4007 2/102
9,072,935 B2 * 7/2015 Ross ..... A63B 23/047
2003/0208832 A1 * 11/2003 VandenBerg ..... A63B 21/065 2/102

* cited by examiner

*Primary Examiner* — Zachary T Moore
(74) *Attorney, Agent, or Firm* — Dunlap Bennett & Ludwig, PLLC

(57) ABSTRACT

A weighted pad for weightlifting is described herein. The weighted pad can be applied to any area of the body to provide additional padding, reduce redness, pain, and bruising. It can be used with dumbbells, barbells, free weights, or any other weight applied over the joints or musculoskeletal regions, making it highly versatile for various exercise.

9 Claims, 4 Drawing Sheets

WEIGHTED PAD FOR WEIGHTLIFTING

BACKGROUND OF THE INVENTION

The present invention relates to pads for weightlifting, and, more particularly, to a weighted pad that can be applied to any area of the body.

During weightlifting, weights are often placed on bony structures of the body, such as on the shoulders, across the back of the neck, or on the pelvis. This can cause various ailments, such as, but not limited to, redness, pain, and bruising. Existing weightlifting pads are made specifically for holding a barbell across the neck and are not designed for use with a dumbbell or other types of weights.

As can be seen, there is a need for a device that is versatile to cover multiple body areas, is compatible with multiple types of weights, stays in place without straps, is flexible, and is portable.

SUMMARY OF THE INVENTION

The weighted pad can be applied to any area of the body to provide additional padding, reduce redness, pain, and bruising. It can be used with dumbbells, barbells, free weights, or any other weight applied over the joints or musculoskeletal regions.

In one aspect of the present invention, the weighted pad includes a flexible rear panel, a middle flap, and right and left flaps. The right, left, and middle flaps extend from the rear panel. In certain embodiments, a cutout may be located between the right and left flaps. In certain embodiments, the cutout can be generally semi-circular or U-shaped. In certain embodiments, the rear panel and right and left flaps may include weights. In certain embodiments, the weights may be attached to the rear panel, right, and left flaps by an adhesive layer. In certain embodiments, the pad may be constructed from foam, such as a closed-cell foam. In certain embodiments, a moisture-resistant coating layer can be applied to the foam layer.

In another aspect of the present invention, a method of making a weighted pad is disclosed, with the method comprising: cutting a foam material to form a weighted pad, such that the weighted pad includes a flexible rear panel, a flexible right flap, and a flexible left flap; cutting the foam material to form a flexible middle flap, wherein a cutout is defined between the right flap and the left flap; coupling at least one rear weight to the rear flap; coupling at least one front weight to the right flap and at least one front weight to the left flap; and applying a moisture-resistant coating to the foam material, the at least one rear weight, the at least one front weight on the right flap, and the at least one front weight on the left flap.

These and other features, aspects and advantages of the present invention will become better understood with reference to the following drawings, description, and claims.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
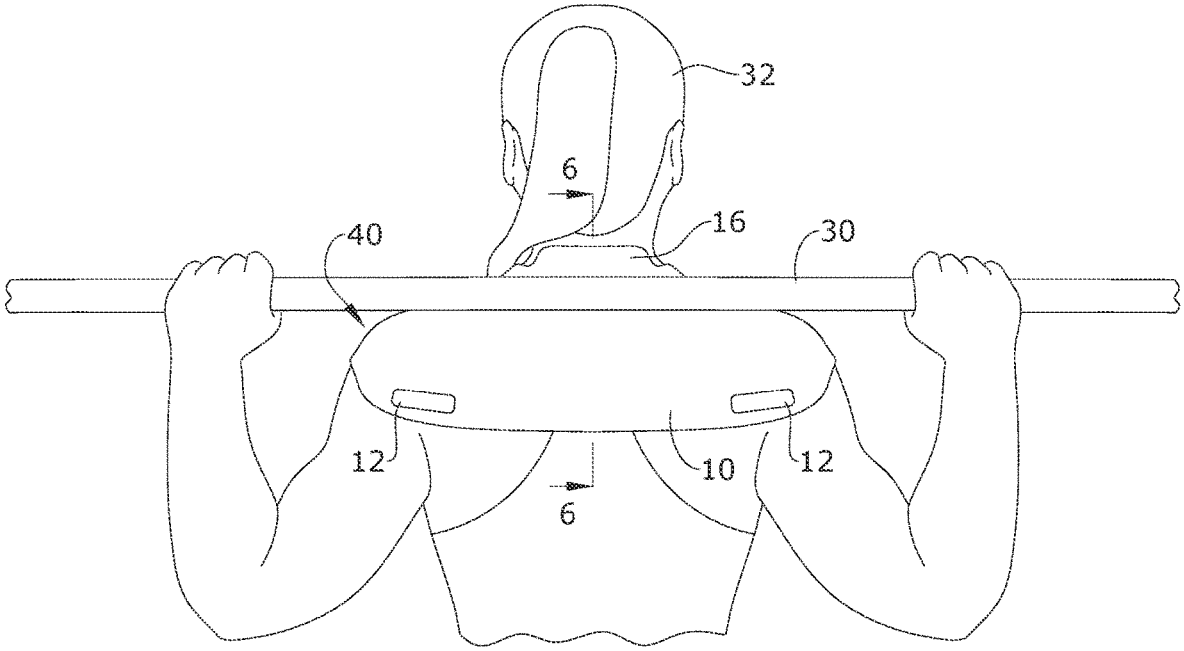
FIG. 1 is a back view of an embodiment of the present invention, shown in use.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without some of these specific details. For the purpose of clarity, technical material that is known in the technical fields related to the present invention has not been described in detail so that the present invention is not unnecessarily obscured.

Broadly, one embodiment of the present invention is a weighted pad for use during weightlifting. The weighted pad can be placed over bony structures or musculoskeletal regions of the body where an individual has applied weight. The weighted pad can reduce the associated redness, pain, and bruising caused by the weight on the specific body region. The weighted pad stays in place when applied over the shoulders without straps and is quick to take on and take off as to not interrupt a workout. The weighted pad can be applied to other areas of the body as padding for weightlifting or when holding weights, such as placement over the pelvis. Alternatively, the weighted pad can be placed on the floor to provide padding for parts of the body. Applying the weighted pad to the body provides additional padding and reduces redness, pain, and bruising.

The weighted pad can be used with dumbbells, barbells, free weights, or any other weights applied over the joints or musculoskeletal regions, including body weight.

Figure 3:
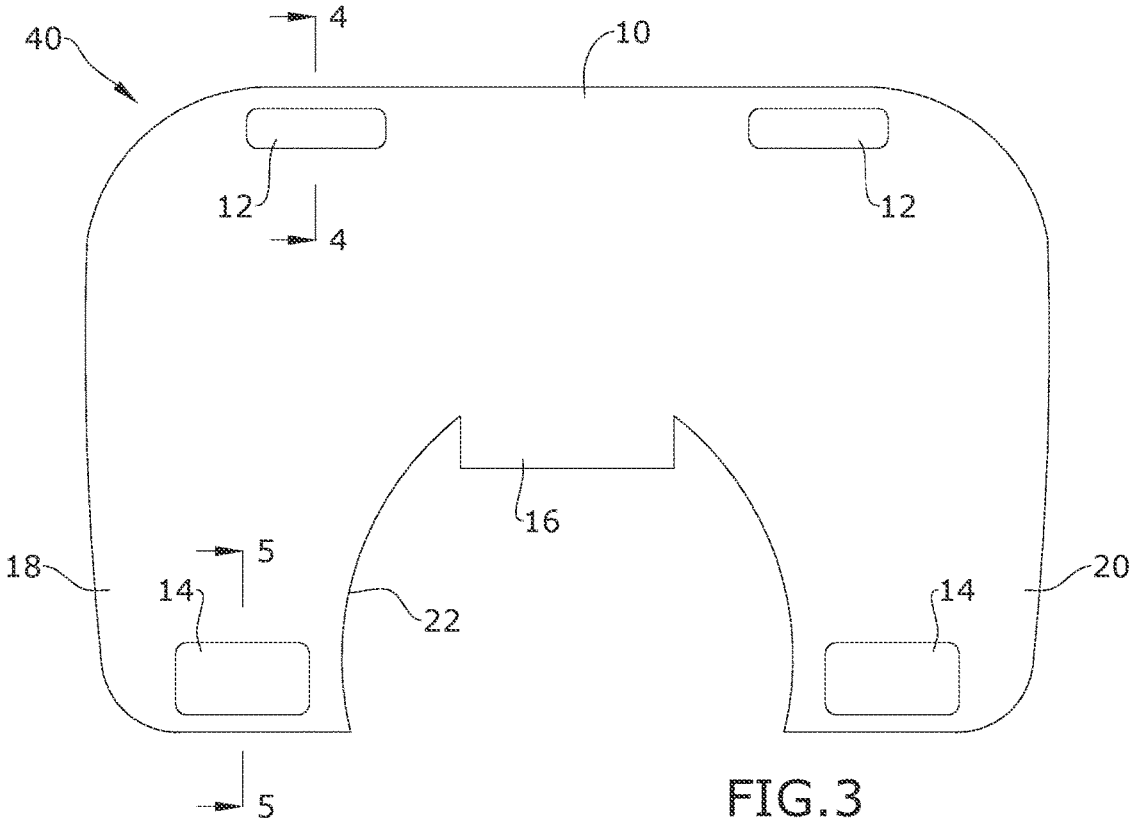
FIG. 3 is a top view of the embodiment of the present invention.

FIG. 3 is a top view of a weighted pad 40, illustrating the design layout. The pad 40 includes a flexible rear panel 10 with a plurality of rear weights 12 coupled thereto. A flexible right flap 18 and a flexible left flap 20 are provided that extend from opposing sides of the rear panel 10. The right flap 18 and left flap 20 each include at least one front weight 14. A flexible middle flap 16 extends from a central region of rear panel 10, between right flap 18 and left flap 20. A cutout 22 is located between right flap 18 and left flap 20, and is generally defined by inner edges of the flaps 16, 18, 20. This cutout 22 can be generally semi-circular in shape, allowing it to comfortably extend around a user's neck or other body parts.

Figure 4:
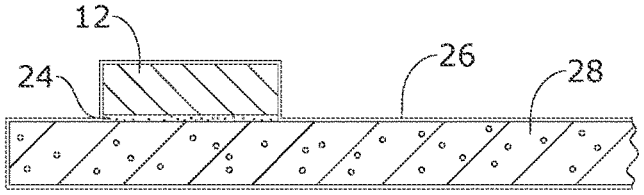
FIG. 4 is a section view of the embodiment of the present invention, taken along line 4-4 in FIG. 3.
Figure 5:
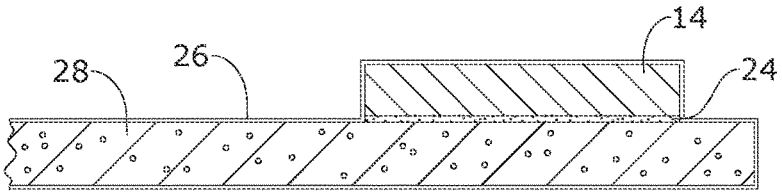
FIG. 5 is a section view of the embodiment of the present invention, taken along line 5-5 in FIG. 3.

FIG. 4 is a section view of the weighted pad 40, taken along line 4-4 in FIG. 3, and illustrating the coupling between a rear weight 12 and the rear panel 10. FIG. 5 is a section view of the weighted pad, taken along line 5-5 in FIG. 3, and illustrating a coupling of a front weight 14 and the right flap 18. The pad 40 includes foam 28 to function as a cushioning layer. In some embodiments, this foam is a closed-cell foam. In certain embodiments, a moisture-resistant coating 26 is applied to the foam 28. An adhesive layer 24 is located between the weighted pad and the weights 12, 14. In some embodiments, the moisture-resistant coating 26 is also applied to the outer surface of the weight 12 or 14, further adhering the weights 12, 14 to the pad 40.

Figure 2:
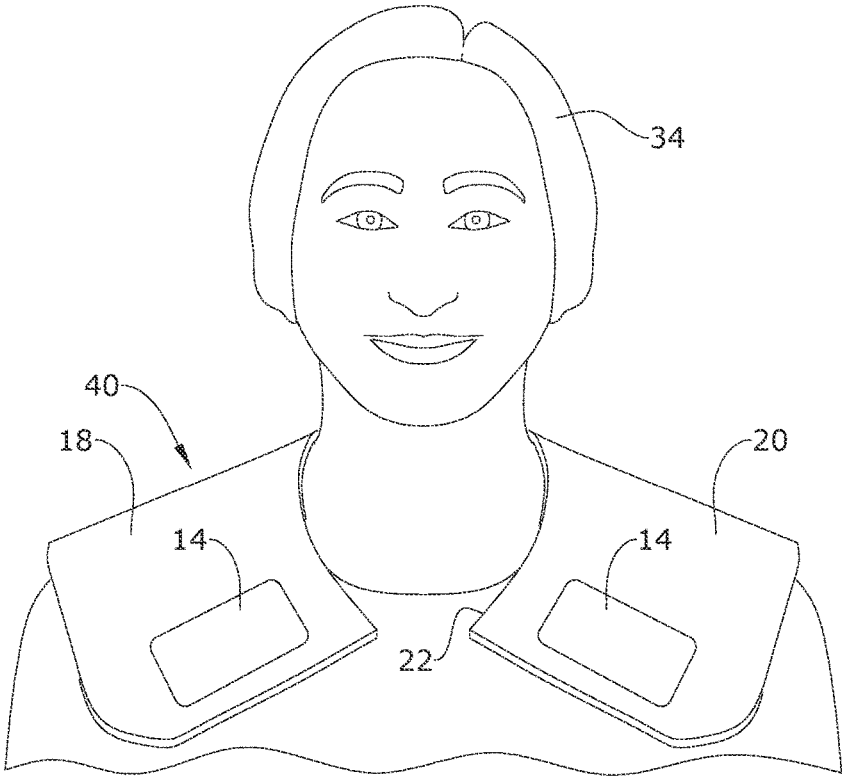
FIG. 2 is a front view of the embodiment of the present invention, shown in use.

Referring now to FIGS. 1-2, the weighted pad 40 is shown in use. FIG. 1 is a back view of the weighted pad 40 placed on the shoulders of a user 32, interposed between the user's shoulders and a barbell 30. When the weighted pad is placed over the shoulders of the user as shown in FIGS. 1 and 2, the rear panel is configured to extend downwardly to cover the user's upper back, and the middle flap 16 is configured extend upwardly to cover the back of the user's neck. FIG. 2 is a front view of the weighted pad 40 placed on the shoulders of another user 34. Front weights 14 are located on the right flap 18 and left flap 20. When the weighted pad 40 is placed over the shoulders of the user 32, as shown in FIG. 2, the right flap 18 is configured to cover the front of the right shoulder, and the left flap 20 is configured to cover the front of the left shoulder. The positioning and sizing of the weights 12, 14, in combination with the coating 26 results in a weight distribution that balances the pad 40 on the user 32, 34, such that the pad 40 is frictionally and securely maintained in place on the shoulders of the user 32, 34. In certain embodiments, the combined weight of the front weights 14 is equal to or slightly more than that of the rear weights 12 to ensure that the pad 40 does not slip off the user's shoulders backwardly.

Figure 6:
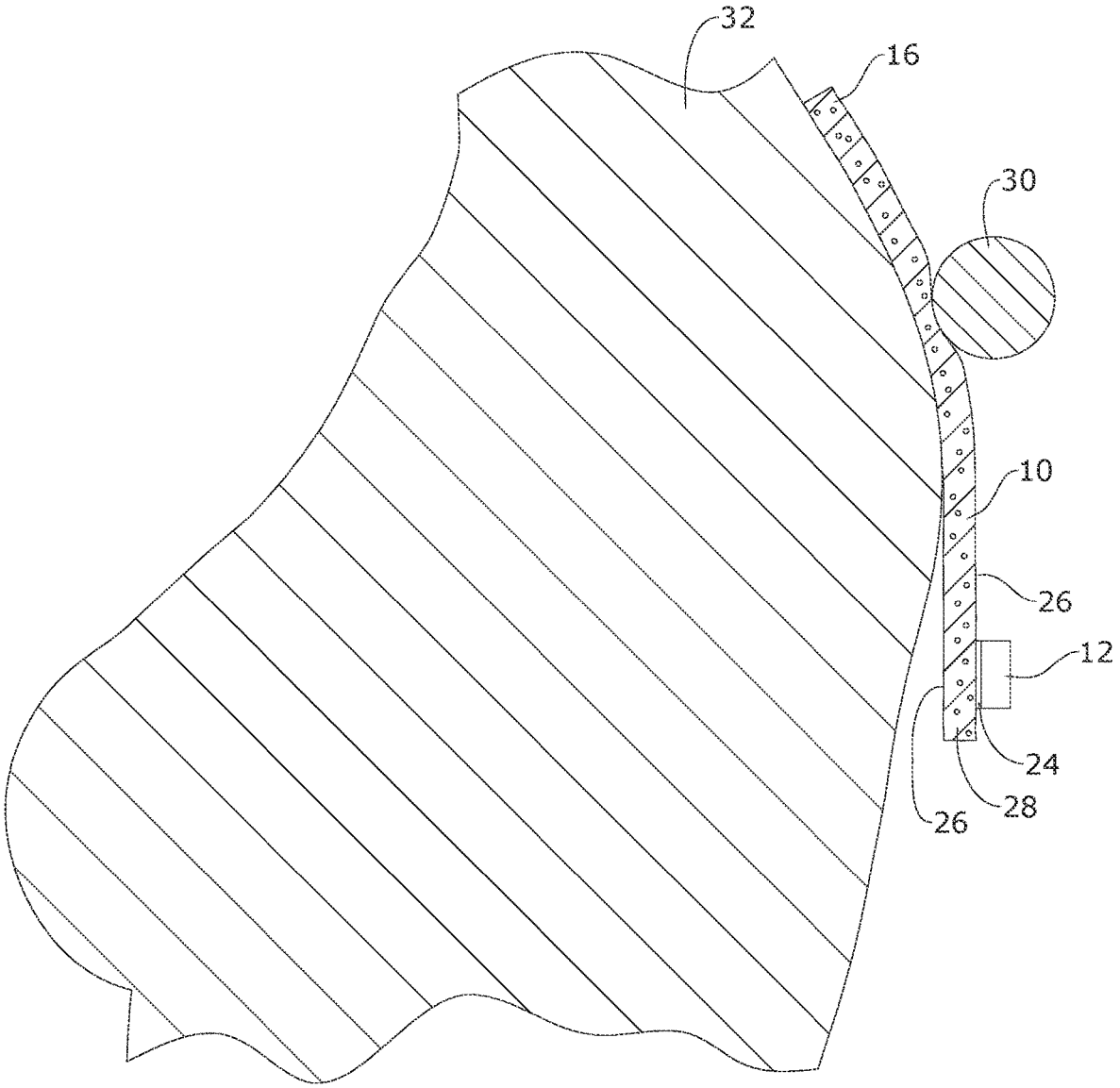
FIG. 6 is a section view of the embodiment of the present invention, taken along line 6-6 in FIG. 1.

FIG. 6 is a section view of the weighted pad, taken along line 6-6 in FIG. 1. The weighted pad is located between a user 32 and a barbell 30, cushioning the lower neck/upper back region of the user 32 from the weight of the barbell 30. As described above, the weighted pad includes the rear panel 10 and the middle flap 16, with a plurality of rear weights 12 being attached to rear panel 10. In some embodiments, rear weight 12 is attached to rear flap 10 by an adhesive layer 24. The pad includes foam 28 and a moisture-resistant coating 26.

Figure 7:
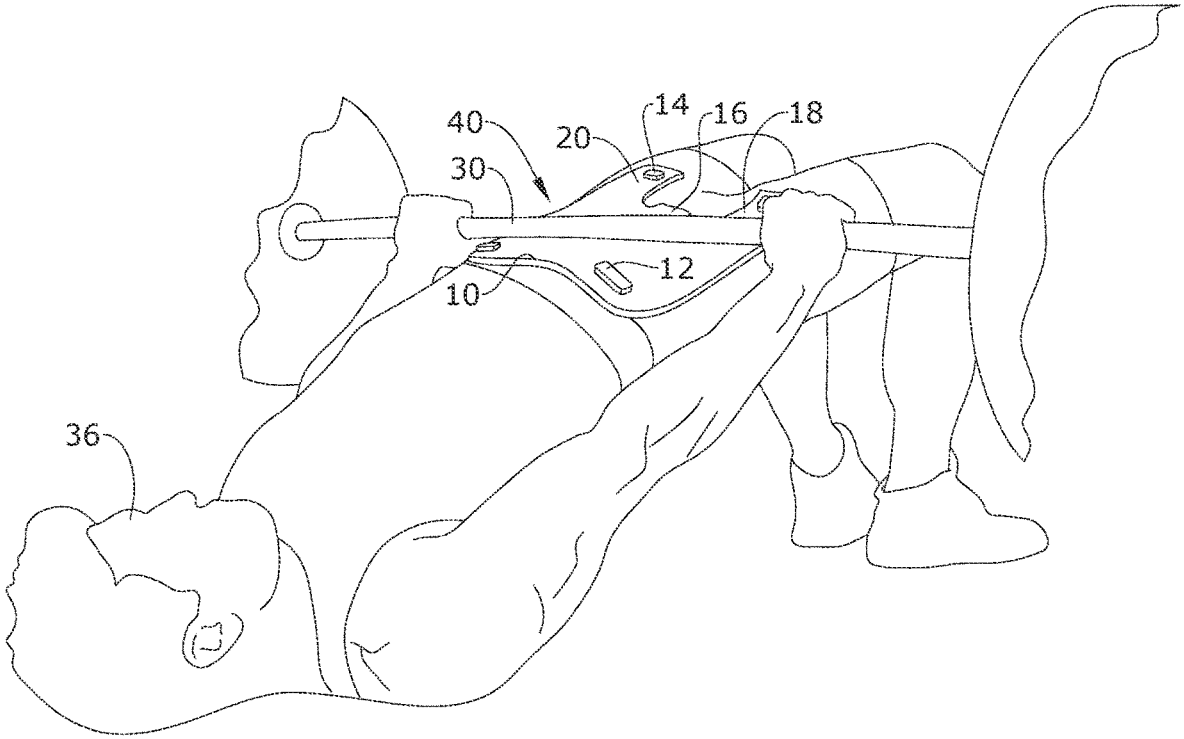
FIG. 7 is a perspective view of an alternate use of the embodiment of the present invention.

FIG. 7 is a perspective view of an alternate use of the weighted pad 40. According to the use shown in FIG. 7, the weighted pad 40 is placed over the pelvic area of a user 36. In this configuration, the weighted pad 40 protects the user 36 from a barbell 30, with the weights 12, 14 maintaining the pad 40 in position over the pelvic are of the user 36.

Figure 8:
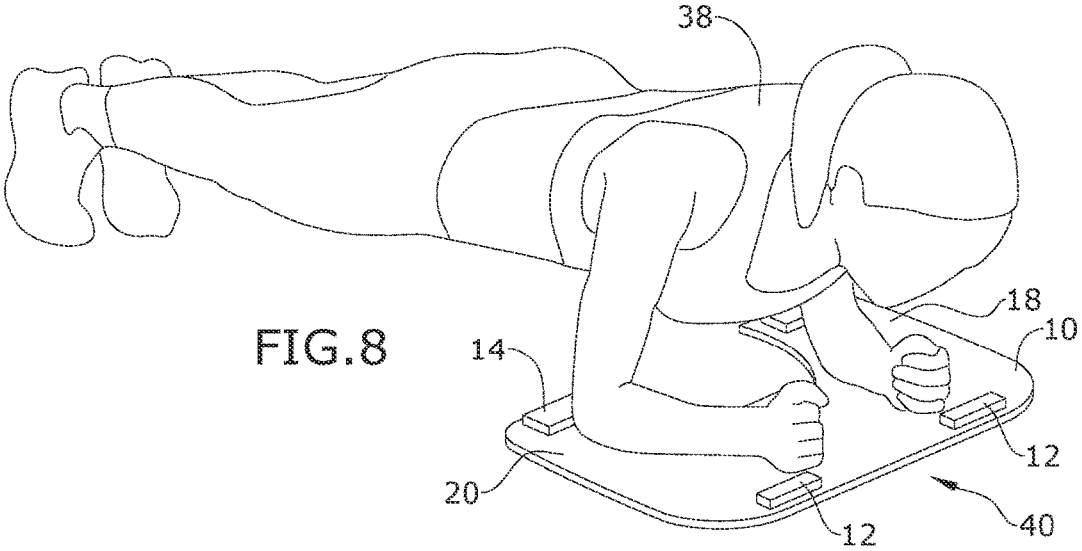
FIG. 8 is a perspective view of yet another alternate use of the embodiment of the present invention.

FIG. 8 is a perspective view of another alternate use of the weighted pad 40. In the use as shown in FIG. 8, the weighted pad 40 is placed on a floor. A user 38 can use the flaps 18, 20 of the pad 40 to protect body parts, such as elbows and arms, from the floor.

In some embodiments, to make the weighted pad 40, closed-cell foam 28 is cut or formed per dimensions. An adhesive 24 which can be applied to the closed-cell foam 28 is used to securely attach weights 12, 14 to the closed-cell foam 28 in the designated area. A moisture-resistant coating 26 is applied to the entire unit. In other embodiments, the moisture-resistant coating 26 is optional. The moisture-resistant coating 26 may not be necessary if the closed-cell foam 28 contains moisture-resistant qualities within the foam 28.

Alternatively, the weights 12, 14 could be covered by additional foam 28, plastic, fabric, or similar materials to hold weight in place instead of or in conjunction with adhesive 24. The weights 12, 14 used may be interchanged for larger or small incremental weights, or a substance such as but not necessarily, sand or other material with similar intent as a weight. The current dimensions may be altered to fit different sizes or shapes, such as, but not limited to, the current U-shape being square, rectangle, or fit individuals of different sizes, such as a child versus adult size or small adult versus large adult size. The thickness of the closed-cell foam 28 may vary. The foam used could be of different material with providing similar intent of the present invention itself.

In some embodiments, a user can place the weighted pad over the shoulders and across the posterior neck and upper back for padding areas of the shoulder, clavicle, upper arms, upper back, posterior neck (FIGS. 1-2).

Alternatively, a user may place the pad over the pelvis or hips when a person is laying supine or on their side to pad the area of pelvis when weight is applied to the pelvis and hip region (FIG. 7). The weight adhered to distal regions of the pad freely holds the pad in place when laying over a body part, extremity, or over the shoulders, or across the posterior neck. Ideally, the weighted pad may be placed over any anatomical location which may become red, painful, or bruised when weight is applied.

While one or more preferred embodiments are disclosed, many other implementations will occur to one of ordinary skill in the art and are all within the scope of the invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Other arrangements, methods, modifications, and substitutions by one of ordinary skill in the art are therefore also considered to be within the scope of the present invention, which is not to be limited except by the claims that follow.

While apparatuses and methods are described in terms of "comprising," "containing," or "including" various components or steps, the apparatuses and methods can also "consist essentially of" or "consist of" the various components and steps. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted. Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A weighted pad for weightlifting, comprising:

a flexible rear panel defined by a rear edge, a first portion of a left edge, and a first portion of a right edge;

a flexible left flap and a flexible right flap extending from opposing sides of the rear panel, wherein the left flap is defined by a second portion of the left edge and a left-front edge, wherein the right flap is defined by a second portion of the right edge and a right-front edge, wherein the left-front edge, the right-front edge, and the rear edge are parallel with each other, wherein the first and second portions of the left edge and the first and second portions of the right edge are parallel with each other; and wherein the rear edge is greater in length than the left edge and right edge;

at least one rear weight coupled to the rear panel;

at least one front weight coupled to the left flap;

at least one front weight coupled to the right flap; and a flexible middle flap extending from the rear panel between the left flap and the right flap, wherein the middle flap is located along and extends into a cutout formed between the left and right flaps, wherein the weighted pad is movable between a flat condition and a shouldered condition, whereby in the flat condition the left and right flaps are coplanar.

2. The weighted pad of claim 1, wherein an edge of the cutout is semi-circular in shape, but for a flap edge of the middle flap.

3. The weighted pad of claim 2, wherein the rear panel, the left flap, the right flap, and the middle flap comprise a foam material.

4. The weighted pad of claim 3, wherein the rear panel, the left flap, the right flap, and the middle flap are integral with one another.

5. The weighted pad of claim 4, further comprising: a first adhesive layer between the foam material and the at least one front weight of the left flap and right flap, and a second adhesive layer between the foam material and the at least one rear weight.

6. The weighted pad of claim 5, further comprising a moisture-resistant layer covering the foam material and the at least one front weight of the left and right flap and the at least one rear weight.

7. The weighted pad for weightlifting of claim 1, wherein the at least one front weight of the left and right flap and the at least one rear weight are positioned and sized so the weighted pad is securely maintained in place on the shoulders of a wearer engaging in barbell weightlifting, whereby the weighted pad does not slip off said shoulders backwardly.

8. The weighted pad for weightlifting of claim 7, wherein a front combined weight of the at least one front weight of the left and right flap is equal to a rear combined weight of the at least one rear weight.

9. The weighted pad for weightlifting of claim 1, wherein the middle flap is shaped and configured to extend upwardly to cover a posterior neck of a wearer of the weighted pad.

* * * * *